United States Patent [19]

Kumandan

[11] 4,361,239

[45] Nov. 30, 1982

[54] SIZE GRADER FOR POD VEGETABLES

[76] Inventor: Krishna R. Kumandan, 306A Parkview Dr., Columbus, Wis. 53925

[21] Appl. No.: 231,180

[22] Filed: Feb. 4, 1980

[51] Int. Cl.[3] ..... B07C 5/06

[52] U.S. Cl. ..... 209/626; 209/664; 209/288; 209/396

[58] Field of Search ..... 209/288, 284, 407, 394, 209/626, 664, 541, 396, 379, 270, 300

[56] References Cited

U.S. PATENT DOCUMENTS

| | | | |
|---|---|---|---|
| 198,440 | 12/1877 | Wilcox | 209/407 X |
| 517,636 | 4/1894 | Youngquist | 209/407 |
| 561,853 | 6/1896 | Amfield | 209/394 X |
| 564,179 | 7/1896 | Asele | 209/394 |
| 1,295,642 | 2/1919 | Urschel | 209/626 |
| 1,682,254 | 10/1928 | Rider | 209/664 |
| 1,727,944 | 9/1929 | Schubert | 209/394 |
| 2,241,977 | 5/1941 | Buck | 209/626 |
| 2,335,891 | 12/1943 | Urschel | 209/626 |
| 2,879,890 | 3/1959 | Romera | 209/394 |
| 2,984,351 | 5/1961 | Vanslych | 209/626 |
| 3,305,090 | 2/1967 | Morawski | 209/407 X |
| 3,608,719 | 9/1971 | Dehler | 309/394 |

FOREIGN PATENT DOCUMENTS

| | | | |
|---|---|---|---|
| 2325418 | 11/1974 | Fed. Rep. of Germany | 209/394 |
| 68259 | 12/1925 | Sweden | 209/288 |
| 403451 | 10/1973 | U.S.S.R. | 209/394 |

*Primary Examiner*—Robert Halper

*Attorney, Agent, or Firm*—Isaksen, Lathrop, Esch, Hart & Clark

[57] ABSTRACT

A size grader for pod vegetables includes a horizontally oriented rotatable drum which contains banks of fixed grading members and movable panels oriented over each bank. The banks and panels are wanted on the drum so as to be parallel to its longitudinal axis. The final grading members and the movable panels have grading vanes which are disposed circumferentially to the drum and transversely to its longitudinal axis. The apertures between the fixed grading vanes and the movable vanes defines grading surfaces. A control rod mounted to the drum longitudinally across each row of panels and operatively engaged with a rowring enables movable panel to move selectively with respect to its corresponding fixed panel as the drum rotates so that the movable panel moves toward the fixed panel in grading position when the panel is in a lower level in the drum and moves away from the fixed bank in a clearing position when the panel is located above the drum.

18 Claims, 14 Drawing Figures

SIZE GRADER FOR POD VEGETABLES

TECHNICAL FIELD

The present invention relates to machines for processing pod-type vegetables and more particularly to machines designed to grade pod vegetables by size.

BACKGROUND OF PRIOR ART

The prior art is generally cognizant of machines for size grading pod vegetables having horizontal, rotating drums in which the vegetables are tumbled, the drums having slits or windows out of which pods that are sufficiently small may fall. Various techniques are used to bring these windows or slits to a preselected grading size as they pass under the mass of vegetables and then to an open, clearing position as the windows or slits reach the top of the drum. The clearing position is useful in releasing pods caught in the slits because the pods have proved too large to pass entirely through them.

Examples of size graders in which the windows or slits have a circumferential orientation substantially transverse to the axis of the drum are shown in Urschel, U.S. Pat. No. 1,295,642, and Ryder, U.S. Pat. No. 1,689,254. Devices in which a series of long, grading slits extend the length of the drum, substantially parallel to the longitudinal axis thereof are seen in Holloway, U.S. Pat. No. 3,831,752, and Grosbety, U.S. Pat. No. 3,241,667.

The maintenance of accuracy of slit width is a common problem in size graders having longitudinal slits, owing to the unsupported length of the members used to establish the size of the slits. Such members are vulnerable to bending and subsequent misalignment. Prior art size graders having circumferentially disposed slits or windows substantially transverse to the longitudinal axis of the drum employ intermeshed inner and outer drums of different diameters. Intermeshed drums present problems concerning wear and misalignment that are referred to in Ryder, U.S. Pat. No. 1,689,254, together with problems of adjustment of the grading openings.

BRIEF SUMMARY OF THE INVENTION

The present invention is summarized in that a size grader for grading pod vegetables includes a substantially horizontal drum having a longitudinal axis and adapted to rotate about the longitudinal axis. The drum is supported in freely turning relation by a frame. Banks are mounted on the drum, extend substantially parallel to the longitudinal axis of the drum, and have fixed grading structures. The fixed grading structures have fixed grading vanes disposed substantially circumferentially to the drum and extending substantially transversely to the longitudinal axis of the drum. A movable panel is oriented over each bank, is mounted on the drum, and is adapted to move selectively toward and away from the bank. The movable panel has panel grading vanes adapted to register with the fixed grading vanes as the panel moves toward the bank. The fixed grading vanes have fixed grading surfaces, and the panel grading vanes have panel grading surfaces. The fixed grading surfaces and panel grading surfaces define grading windows, the grading windows decreasing in size as the panel moves increasingly toward the bank. The size grader has means for selecting and changing the position of the panels relative to the banks as the drum rotates, to cause the panel grading vanes to move toward the fixed grading vanes into a selected grading position to define grading windows of a selected size while the panel is passing beneath the pod vegetables in the drum and to move away from the fixed grading vanes and into a clearing position as the panel passes above the drum.

It is an object of the present invention to provide a size grader for pod vegetables in which grading windows are circumferentially disposed on a drum, the size of which windows may be accurately determined and maintained.

Another object of the invention is to provide for the inexpensive and convenient replacement of parts employed to define grading windows, should those parts become broken or misaligned.

It is yet another object of the invention to provide a size grader with relatively few moving parts and with moving parts of reduced complexity.

It is yet another object of the invention to provide for the placement of moving parts on the outside of the drum where they may be visible and easy to adjust and maintain.

It is yet another object of the invention to provide for the substantially vertical orientation of pods as they are presented to the grading windows for grading, with the end of improving the efficiency of the pod grader.

It is yet another object of the invention to provide a size grader for pod vegetables in which the size of the grading windows may be adjusted over a broad range of sizes, such adjustment to be possible both when the machine is operating and when it is not.

Other objects, advantages, and features of the present invention will become apparent from the following specification when taken in conjunction with the accompanying drawings.

DETAILED DESCRIPTION OF THE PREFERRED EMBODIMENT

Figure 1:
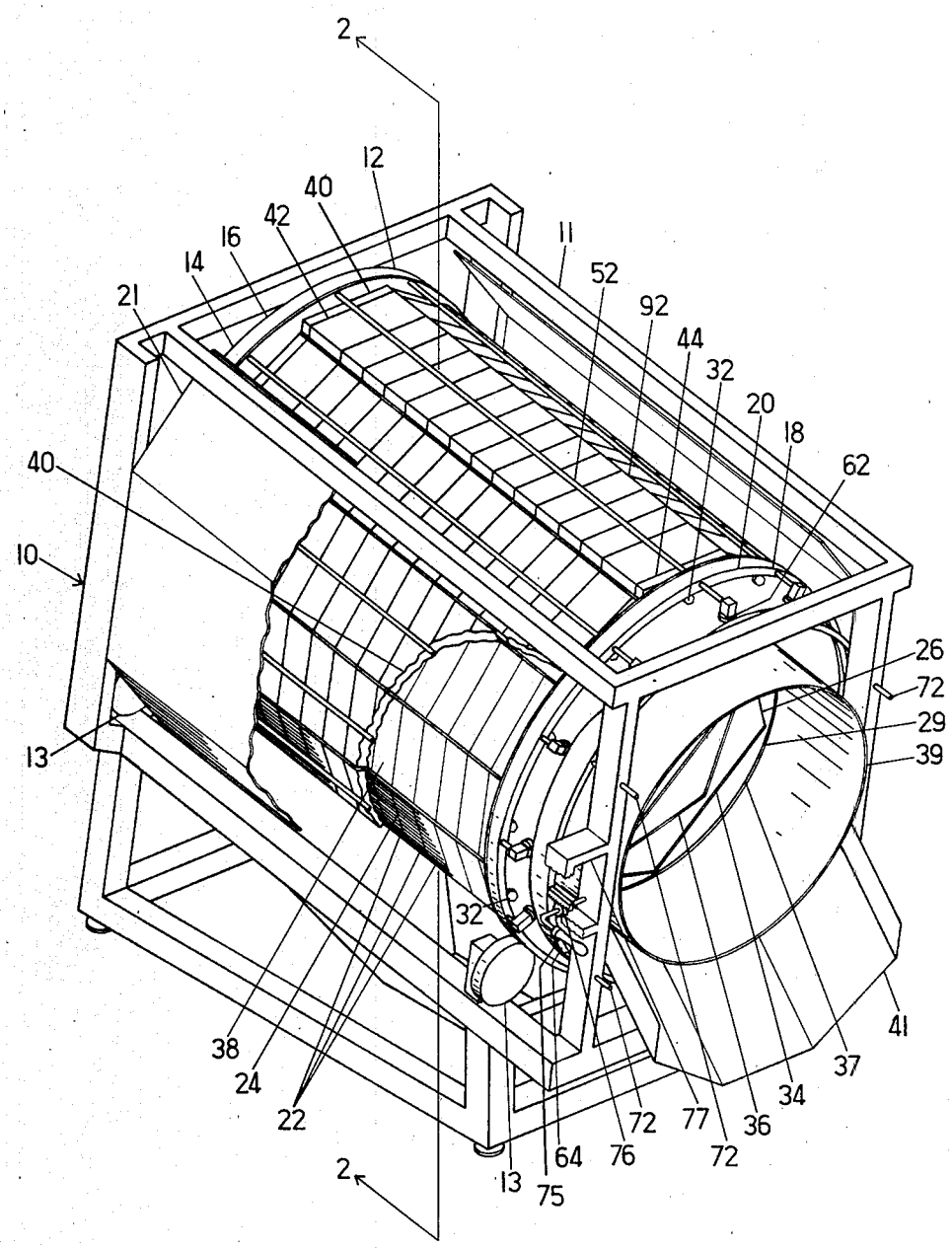
FIG. 1 is a perspective view of a first preferred embodiment of the size grader of the invention from the discharge end, with portions of the protective covering and movable panels, broken away and with the fixed grading structures and the panel grading structures shown schematically.

Referring more particularly to the drawings, wherein like numbers refer to like parts, FIG. 1 illustrates a first embodiment of the size grader of the invention, shown generally at 10. The size grader has a frame 11 and a substantially horizontal, substantially cylindrical drum 12. The drum 12 is supported by the frame 11 on rollers 13 or equivalent conventional means for support and is adapted to rotate about its longitudinal axis. The drum 12 has a feed endplate 14 that defines the feed end 16 of the drum 12. A discharge endplate 18 defines the discharge end 20 of the drum 12. Preferably, the feed end 16 is elevated to a selected level above the discharge end 20. A safety shield 21 rigidly attached to the frame 11 encloses each side of the drum 12 for a selected distance vertically.

At least one and preferably a plurality of cylindrical segments 22 having fixed grading structures 24 are arranged end-to-end in an axial direction along the drum 12. A partition 26 extends transversely from between each adjacent cylindrical segment 22. A feed end partition 27 extends transversely between the feed endplate 14 and the cylindrical segment 22 closest to the feed endplate. Similarly, a discharge end partition 29, shown in FIG. 1, extends transversely between the discharge endplate 18 and the cylindrical segment 22 closest to the discharge endplate. The feed endplate 14, discharge endplate 18, each partition 26, the feed end partition 27, and the discharge end partition 29 have edges defining a multiplicity and preferably twelve corresponding fastening holes 28 (as shown in partition 26 in FIG. 6). Preferably, the fastening holes 28 are equally spaced about the periphery of the endplates 14 and 18 and the partitions 26, 27, and 29. Drum tiebars 30 extend the length of the drum 12, one drum tiebar 30 passing through each set of corresponding fastening holes 28. Preferably, the drum tiebars 30 are tubular to reduce weight. Nuts 32 or equivalent conventional end fasteners retain the endplates 14 and 18 and the partitions 26, 27, and 29 on the drum tiebars 30.

Each partition 26 has edges defining a central passage 34 therethrough. Each central passage 34 is defined by a multiplicity of, and preferably in the range of six to eight, substantially straight edges 36 of equal length. In the preferred embodiment, the edges 36 are straight, but clearly any edges that are substantially straight, including curved edges having a sufficiently large radius of curvature to function in an equivalent manner, could also be employed without departing from the spirit of the invention.

End partitions 27 and 29 have edges defining central passages 35 and 37, respectively. Preferably, passages 35 and 37 are circular with a selected radius and centered on the longitudinal axis of the drum 12. A discharge tube 39 is rigidly attached to and extends outwardly from the edges defining passage 37, the tube 39 extending sufficiently far that pods discharged from it will fall into a desired receptacle, such as chute 41.

In use, the drum 12 is rotated about its longitudinal axis by any conventional means for rotating the drum of a rotating-drum vegetable processing machine. As the drum 12 rotates, the edges 36 are drawn successively through a mass of pods that have been introduced to the drum through the feed end passage 35, the edges 36 moving transversely to the mass of pods. The partitions 26 are so oriented within the rotating drum 12 that their edges 36 are in circumferentially displaced relation with respect to the corresponding edges 36 of each next adjacent spaced partition 26. This orientation of the adjacent partitions 26 provides an agitating passageway through the drum 12 having an uneven effective surface as provided by the circumferentially displaced edges 36. Rotation of the drum 12 to draw successively angled and displaced edges 36 transversely through the mass of pod vegetables within the drum agitates and breaks up the mass and prevents "roping" of the mass through the drum in a known manner.

The fixed grading structures 24 extend laterally relative to the drum 12, each being rigidly attached to and filling the space between adjacent circumferentially spaced drum tiebars 30. The fixed grading structures 24 also extend longitudinally relative to the drum 12 for a selected distance between the partitions 26 to establish the size of and fill the space between the partitions. Taken together, the fixed grading structures 24, and that part of each partition 26 which combines with the fixed grading structures to fill the space between any two particular adjacent drum tiebars 30, form a bank 38 of fixed grading structures that extends longitudinally for substantially the length of the drum 12 and is mounted thereon. In the preferred embodiment, which has twelve drum tiebars 30, twelve banks 38 are formed. The structure of the fixed grading structures 24 is described in detail below.

A movable panel 40 is located above and in a plane that is parallel to the plane of each bank 38. Each movable pnael 40 is mounted on the drum 12 and is selectively movable relative to the corresponding bank 38 in a direction parallel to that radius of the drum that bisects the bank 38. All of the panels 40 are the same in structure, and subsequent references to one such panel apply to all of them.

Figure 2:
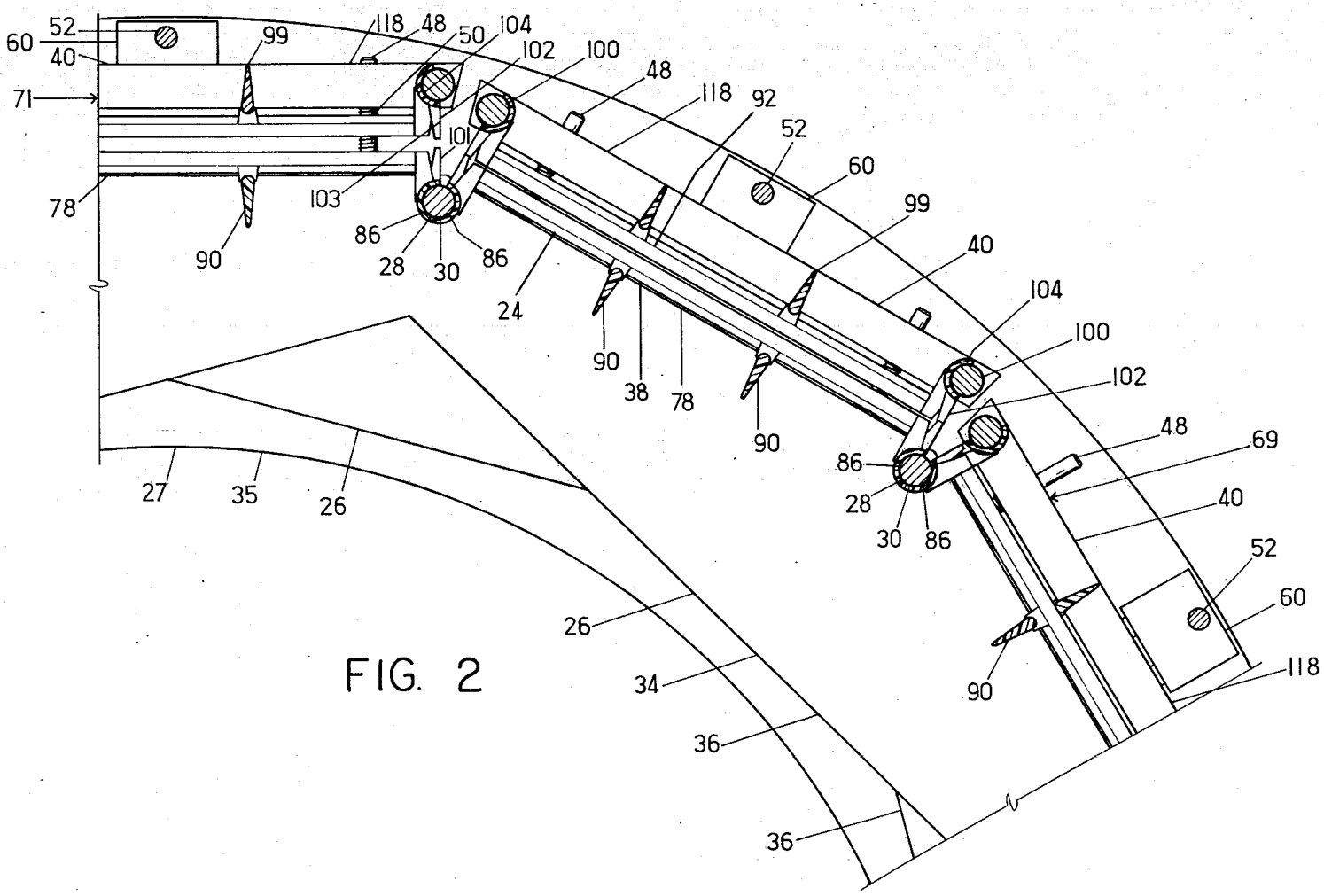
FIG. 2 is a cross sectional view of a broken away portion of the drum shown in FIG. 1, taken along section lines 2—2.
Figure 3:
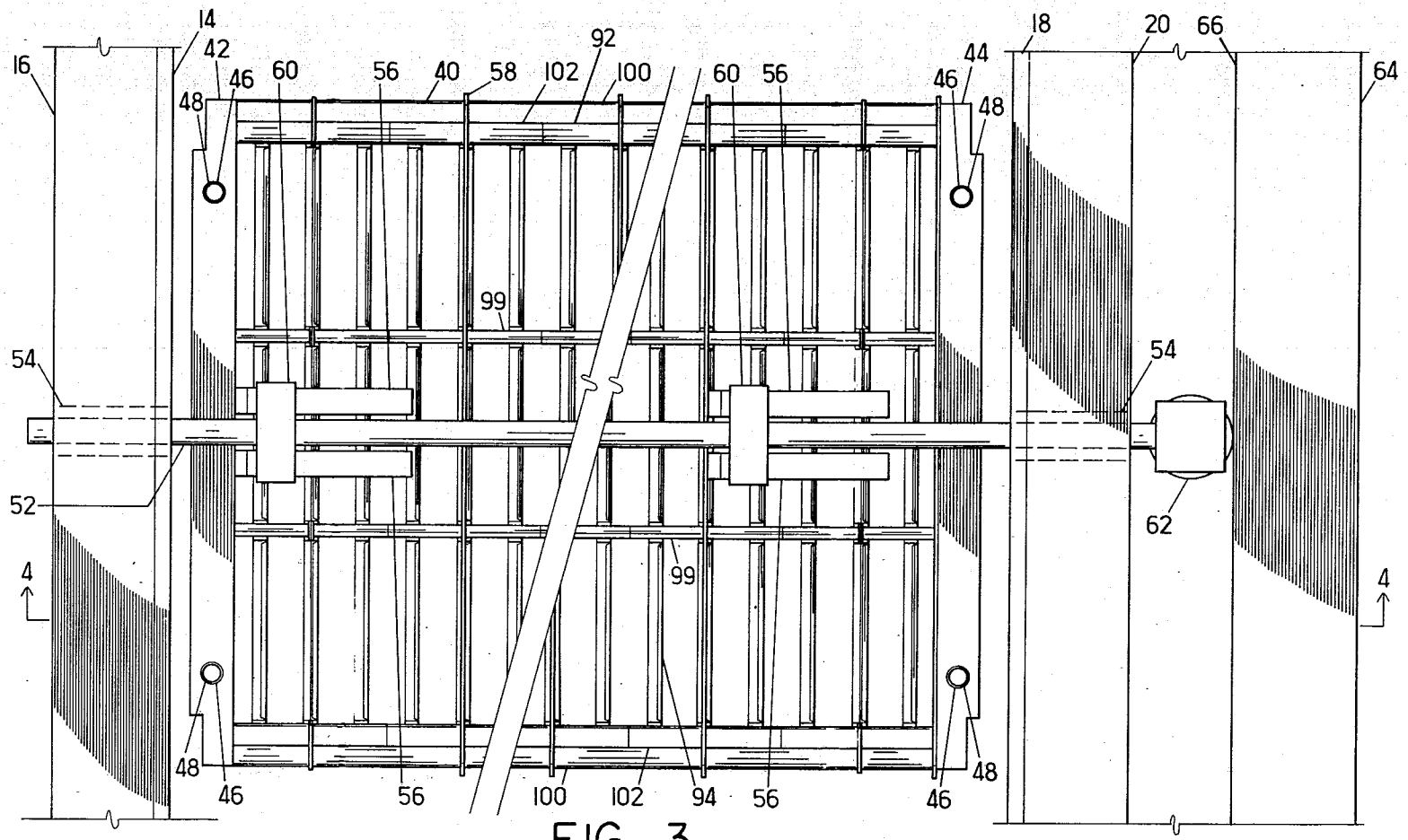
FIG. 3 is a plan view of a movable panel of the embodiment shown in FIG. 1, together with associated structures.

Preferably, the movable panel 40 is rectangular and has a feed endcap 42 and a discharge endcap 44, as best shown in FIG. 3. The panel has at least one and preferably two panel bushings 46 located in each endcap 42 and 44 of the panel and extending in a direction parallel to the radius of the drum 12 that bisects the associated bank 38. Guide pins 48 are rigidly fastened to the bank 38 and adapted to extend through and slideably engage the bushings 46. Consequently, when in place over the bank 38, the panel 40 may slide on the guide pins 48 and is thereby held in a plane substantially parallel to that of the bank at the same time that sideways movement relative to the bank is prevented. The panel 40 is biased away from the bank 38 by a suitable conventional means for biasing, such as helical springs 50, shown in FIGS. 2 and 4, that surround each guide pin 48 intermediate between the bank 38 and the movable panel 40.

The size grader 10 of the invention has a means for selectively controlling the distance between the movable panel 40 and the bank 38. In the embodiment shown in FIG. 1, a control rod 52 extends across the panel 40 in a direction substantially parallel to the longitudinal axis of the drum 12, the control rod being centered over the panel. The feed endplate 14 and the discharge endplate 18 each have a control rod bushing 54 (shown in phantom in FIG. 3) that slideably engages the control rod 52, thus preventing any circumferential movement of the control rod while permitting substantially free movement of the control rod parallel to the longitudinal axis of the drum 12.

Figure 4:
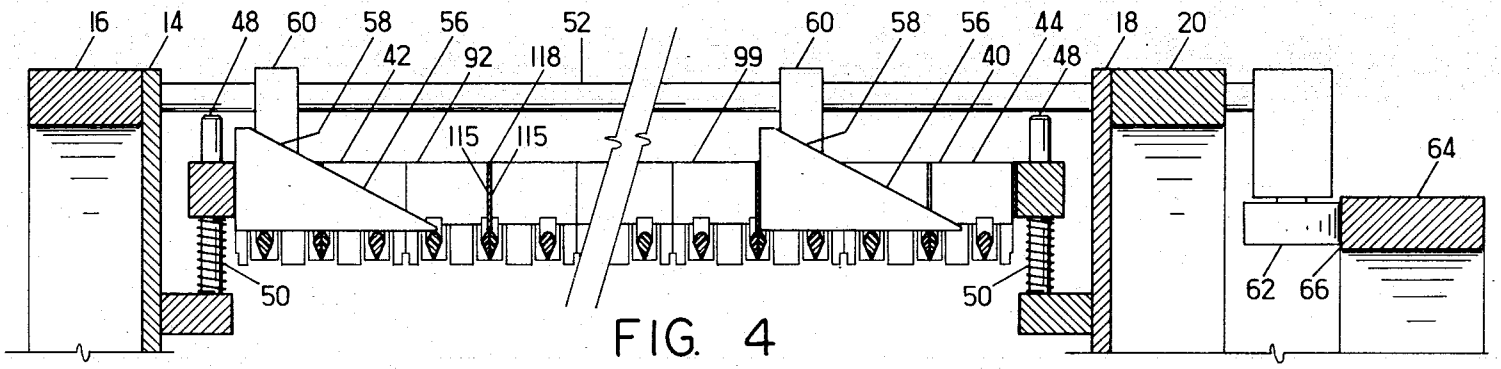
FIG. 4 is a cross sectional of the movable panel shown in FIG. 3, taken along sectional lines 4—4.

At least one cam block 60 is rigidly attached to each control rod 52. Each cam block 60 has a straight, inclined cam surface 58 facing toward and extending longitudinally relative to the drum 12, as best shown in FIG. 4. Preferably the cam surface 58 is so inclined that the end nearest the discharge endplate 18 is also nearest to the drum 12. A cam block follower 56 is slideably engaged with the cam surface 58. The cam block follower 56 is rigidly attached to the movable panel 40 and is biased against the cam surfaces 58 by action of the helical springs 50. As the control rod 52 is moved toward the feed endcap 42 of the panel 40, carrying the cam blocks 60 with it, the cam block followers 56 (and therefore the panel 40 to which they are rigidly attached) are increasingly depressed toward the drum 12. Movement of the control rod 52 toward the discharge endcap 44 of the movable panel 40 allows the cam block followers 56 and attached panel 40 to move away from the drum 12, driven by the biasing pressure of the springs 50. As is best shown in FIG. 3, preferably two cam blocks 60 are attached to each control rod 52 at selected positions over the panel 40, each cam block 60 extending on either side of the control rod to be engaged by two substantially identical cam block followers 56, symmetrically arranged on opposite sides of the control rod.

The control rod 52 extends for a selected distance beyond the discharge endplate 18. A cam follower wheel 62 is attached to the control rod 52 at a selected point beyond the discharge endplate 18. The cam follower wheel 62 is so attached as to rotate freely with its axis always oriented substantially on a radius of the cylinder 12.

Figure 7:
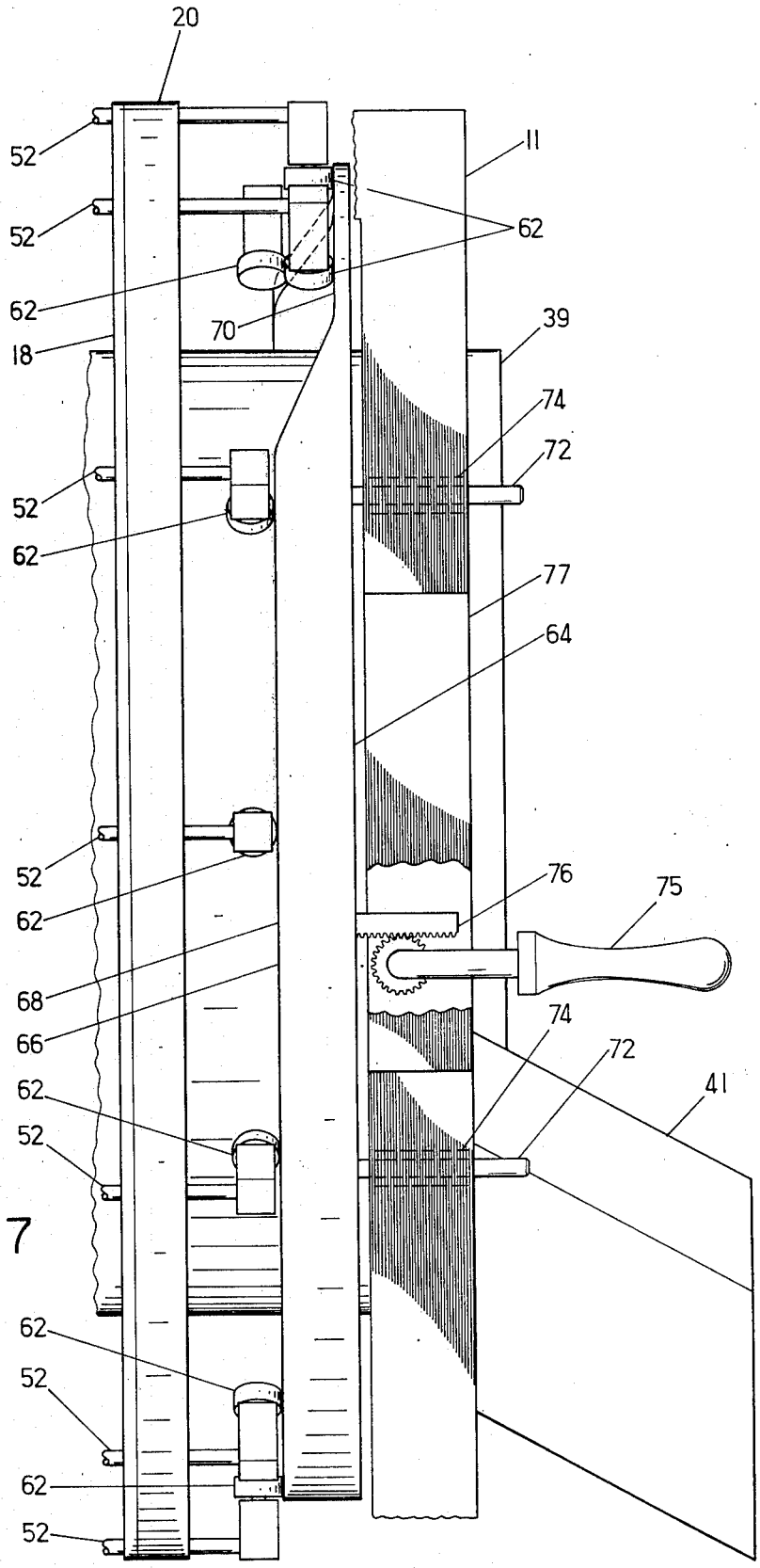
FIG. 7 is a side elevation view of the cam ring, cam follower wheels, and associated structures of the embodiment shown in FIG. 1.

A cam ring 64 supported by the frame 11 faces the discharge end 20 of the drum 12. The cam ring 64 has a cam ring surface 66, best shown in FIG. 7, adapted to engage the cam follower wheels 62 of the control rods 52. The cam follower wheels 62 are biased against the cam ring surface 66 by pressure from the springs 50 transmitted to the control rods 52 and thence to the cam follower wheels 62 by the interaction of the cam block followers 60 and the cam surfaces 58 of the cam blocks 56. The cam ring surface 66 has a grading level 68 selected to be such that when a cam follower wheel 62 is engaged therewith, the associated movable panel 40 will be depressed toward the corresponding bank 38 of the drum 12 to assume a selected grading position. The cam ring surface 66 also has a clearing level 70 located at the top portion of the cam ring surface. The clearing level 70 is selected to be such that when a cam follower wheel 62 is engaged therewith, the associated movable panel 40 will move away from the corresponding bank 38 to assume a selected clearing position. In the embodiment as described above, the clearing level 70 is more distant from the discharge end 20 of the drum 12 than is the grading level 68, as shown in FIG. 7. The relative positions of panels 40 in clearing and in grading positions are best shown in FIG. 2, where the panel 40 shown at 71, at the top of the drum 12, is in clearing position and the panel 40 most distant from the top shown at 69, is in grading position.

The cam ring surface 66 is adapted to allow the cam follower wheel 62 to smoothly travel over the surface, passing from the grading level 68 to the clearing level 70 and back repeatedly as the drum 12 rotates. With each rotation of the drum 12, each movable panel 40 is thus first moved to the grading position as its cam follower wheel 62 engages the grading level 68. The position of the grading level 68 is selected to so act on the cam follower wheel 62 before the associated bank 38 of fixed grading structures 24 has passed under the mass of vegetables contained in the drum. The grading position is maintained as the bank 38 moves under the vegetables and up beyond them toward the top of the drum 12, whereupon the cam follower wheel 62 moves to the clearing level 70, causing the movable panel 40 to move once more to the clearing position. Thus, the movable panel 40 moves to the clearing position every time that it is carried to the top of the rotating drum 12, assuming and maintaining the grading position as it is carried down the descending side of the drum and under the mass of pod vegetables.

The cam ring 64 is adapted to be selectively moved toward or away from the discharge end 20 in a direction parallel to the longitudinal axis of the drum 12. The cam ring 64 has at least one and preferably four cam ring supports 72 rigidly attached to the cam ring and extending away from the discharge end 20 of the drum 12 for a selected distance in a direction parallel to the longitudinal axis of the drum. Frame bushings 74 are rigidly attached to the frame 11 and receive the cam ring supports 72 in slideable relation. Means for adjusting the position of the cam ring 64, such as the conventional rack and pinion shown at 76 with handle 75 and support 77, allow the operator of the size grader 10 to selectively position the cam ring surface 66 relative to the discharge end 20 of the drum 12. By so selecting the position of the cam ring surface 66, the operator may adjust the grading position to which the panel 40 is moved when the cam follower wheels 62 are in engagement with the grading level 68 of the cam ring surface. It will be appreciated that the position of the cam ring may be adjusted readily both while the drum 12 is rotating and while it is stationary. A conventional means for locking the cam ring 64 in the position selected, such as a friction brake (not shown) on the rack and pinion 76, maintains the selected position of the cam ring 64 and the corresponding selected grading position.

Figure 5:
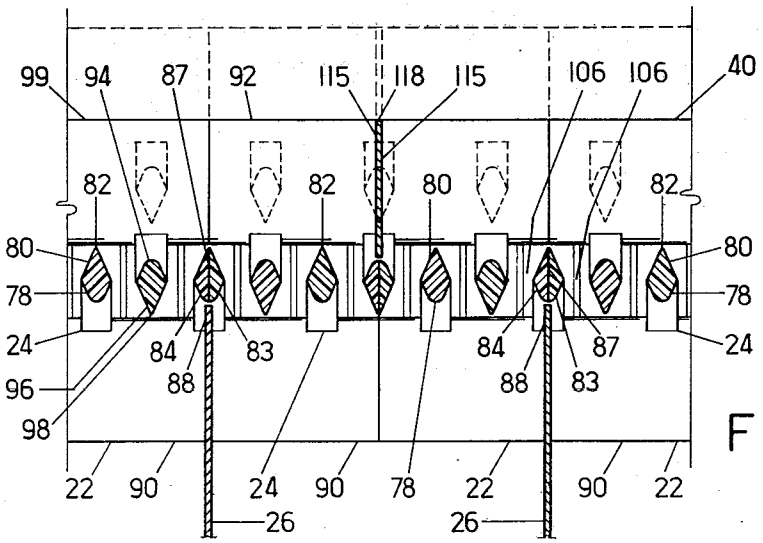
FIG. 5 is a cross sectional view similar to FIG. 4 showing a broken away portion of a movable panel together with a broken away portion of the corresponding bank.
Figure 6:
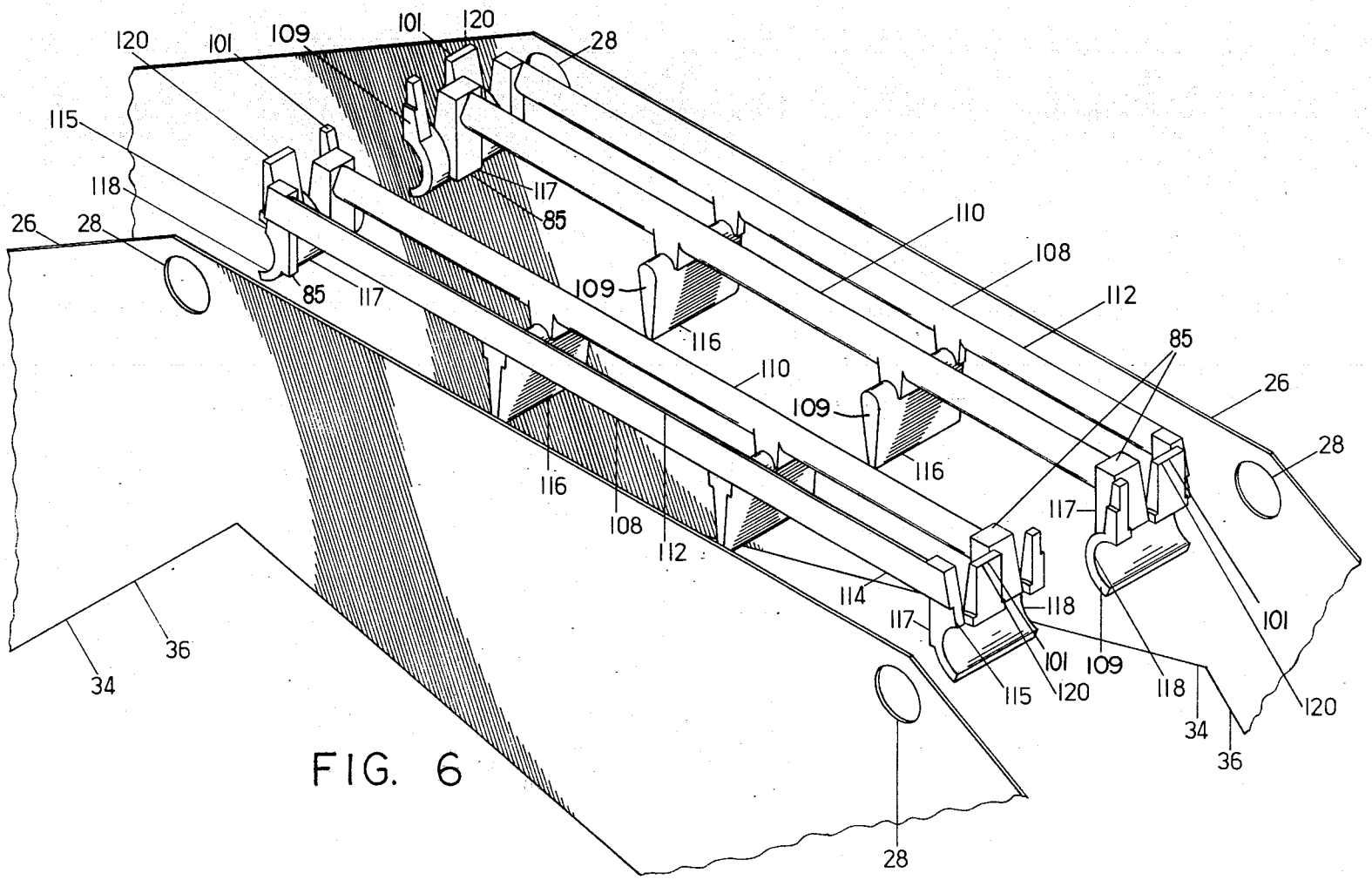
FIG. 6 is an exploded perspective view of two partitions and two grading segments of the embodiment shown in FIG. 1, showing their relative positions when assembled to form a part of the drum.

The fixed grading structures 24 have equally spaced, fixed grading vanes 78 extending substantially circumferentially between adjacent drum tie bars 30, as best shown in FIGS. 2 and 6. Preferably, the fixed grading vanes 78 are substantially identical. As best shown in cross section in FIG. 5, fixed grading surfaces 80 extend from a section of greatest width of the vane 78 away from the drum 12 to a point of lesser width at that edge of the vane 78 most remote from the axis of the drum, hereinafter referred to as the leading edge 82 of the fixed grading vane. Preferably, the cross section of that part of the vane 78 extending from the section of greatest width to the leading edge 82 forms an isosceles triangle having its base at the section of greatest width. Surfaces extend from the section of greatest width inwardly toward the axis of the drum 12, preferably presenting a rounded, smooth surface toward the interior of the drum, although flat, sharply angled, or other configurations may also be used within the spirit and scope of the invention.

Preferably, the fixed grading structure 24 has a half vane 83 on the side of the fixed grading structure 24 facing the discharge end 20 of the drum 12 and a second half vane 84 facing the feed end 16 of the drum. Each half vane 83 and 84 has the shape of a vane 78 that has been vertically bisected along the length of the vane 78. The flat side 87 of each half vane 83 and 84 faces away from the fixed grading structure 24. When a half vane 83 of one fixed grading structure 24 is abutted against the opposing half vane 84 of a second fixed grading structure, the two half vanes taken together function as a single vane 78. The half vanes 83 and 84 are the same distance from the adjacent vane 78 as are adjacent vanes 78 from each other. By this means, a series of fixed grading structures 24 present an unbroken array of equally spaced and substantially identical vanes for the entire length of the array.

End structures 85 are located at each end of the fixed grading structures 24, as best shown in FIG. 5. The end structures 85 have surfaces defining outwardly facing arcuate attachment members 86. The arcuate attachment members 86 have a radius of curvature selected to be the same as that of the outer surface of the drum tiebars 30 and adapted to embracingly engage a tiebar 30. The elasticity of the fixed grading structures 24 and the arc of the arcuate attachment members 86 are selected to allow the fixed grading structures to elastically deform sufficiently to snap over a pair of adjacent drum tiebars 30 when pressed firmly against them from outside the drum 12. By this means, fixed grading structures 24 may be replaced, should they become worn or broken, by removing the defective structure and snapping a new one into place from outside the drum 12 and without the need to disassemble the drum.

The fixed grading structures 24 have surfaces defining a partition notch 88 extending transversely to the axis of the drum 12 when the fixed grading structures are in place between the drum tiebars. Preferably, half a partition notch 88 is formed under each half vane 83 and 84, so that an entire partition notch 88 is formed at the junction between contiguous fixed grading structures 24. The width of each partition notch 88 is selected to receive a transverse partition 26, allowing banks 38 of fixed grading structures 24 and interleaved partitions 26 to be built up as the drum 12 is assembled without the introduction of any gap or irregularity in the array of fixed grading vanes 78, as best shown in FIG. 5.

At least one and preferably two reinforcement members 90 extend interiorally from the fixed grading structure 24 and parallel to the longitudinal axis of the drum 12 for a selected distance. The reinforcement members 90 are rigidly attached to the half vanes 83 and 84 and the vanes 78 of the fixed grading structure 24, rendering the vanes and half vanes more rigid and capable of withstanding pressures exerted against them by vegetables placed within the drum. For reasons explained below, it is preferable that the reinforcement members 90 be spaced from each other and from the end structures 85 by a distance selected to be smaller than the average length of the pod vegetables to be graded.

Referring again to FIG. 2, it is seen that the movable panel 40 has panel grading structures 92 extending for substantially the width of the panel 40 in parallel relation to the fixed grading structures 24. The panel grading structures 92 have panel grading vanes 94 extending parallel to the fixed grading vanes 78 of the bank 38 beneath the movable panel 40. As shown in FIG. 5, the panel grading vanes 94 are substantially identical in shape to the fixed grading vanes 78. Panel grading surfaces 96 extend from a section of greatest width of each vane 94 toward the drum 12 to a point of lesser width at that edge of the vane 94 nearest to the axis of the drum, hereinafter referred to as the leading edge 98 of the panel grading vane. The cross section of that part of each panel grading vane 94 extending from the section of greatest width to the leading edge 98 forms an isosceles triangle having its base at the section of greatest width and the same in size and proportions to the corresponding part of the fixed grading vanes 78, as described above. At least one reinforcement member 99 extends rigidly from the vanes 94 at a right angle to the longitudinal axis of the drum 12.

Two tubular panel tiebars 100 extend for the length of each panel 40 in a direction substantially parallel to the longitudinal axis of the drum 12. The panel tiebars 100 of each panel 40 are rigidly attached to the feed endcap 42 and discharge endcap 44 of that panel, as shown in FIG. 3. End structures 102 are located at each end of the panel grading structures 92 and have surfaces defining outwardly facing arcuate attachment members 104 shown in FIG. 2. The arcuate attachment members 104 have a radius of curvature selected to be the same as that of the outer surface of the panel tiebars 100. The elasticity of the panel grading structures 92 and the arc of the arcuate attachment members 104 are selected to allow the panel grading structures to elastically snap over the panel tiebars 100 when pressed firmly against them. By this means, panel grading structures 92 may be replaced by removing a defective structure and snapping a new one into place without the need to disassemble the panels 40.

The end structures 85 of each fixed grading structure 24 have laterally displaced locator fingers 101 adapted to register with corresponding locator fingers 103 on the end structures 102 of the corresponding panel grading structure 92, when the panels 40 are in place over the banks 38. With the panels 40 so located, the leading edges 82 of the fixed grading vanes 78 substantially face the leading edges 98 of the panel grading vanes 94. The panel grading vanes 94 are so oriented relative to the fixed grading vanes 78 that one panel grading vane is parallel to and centered between each pair of fixed grading vanes. As each panel 40 is increasingly depressed toward the corresponding bank 38, the panel grading vanes 94 enter the spaces between the fixed grading vanes 78, as best shown in FIG. 5. The space between each panel grading surface 96 and the adjacent fixed grading surface 80 forms a grading window 106. As a panel 40 is increasingly depressed, the panel grading vanes 94 are increasingly thrust between the fixed grading vanes 78, causing the panel grading surfaces 96 to more nearly approach the fixed grading surfaces 80, increasingly constricting the size of the grading windows 106. The degree to which the movable panels 40 are depressed toward the underlying banks 38 when in the grading position, as discussed above, thus determines the size of the grading windows 106. When the panel 40 is moved to the clearing position, as discussed above, the panel grading surfaces 96 and fixed grading surfaces 80 are pulled back from each other and the grading windows 106 are made larger, as is shown in phantom in FIG. 5.

When a mass of pod vegetables has been placed in the drum 12, those pods located at the periphery of the drum fall by gravity against the interiorally facing structures of the drum, including the partitions 26, the reinforcement members 90, the end structures 85, and the fixed grading vanes 78. Sufficiently small portions of some of the pods will pass through the grading windows 106. Because the distance between the reinforcement members 90 and between the reinforcement members and adjacent end structures 85 is selected to be less than the average length of the pods, the pods tend not to lie lengthwise in the grading windows 106. Instead, one end of each pod is held up by a reinforcement member 90, end structure 85, or partition 26, placing the pod in an end-on orientation relative to the grading windows 106. If the thickness of the pod is less than the predetermined width of the grading window, it will fall through the grading window 106 and out of the drum 12. If the part of the pod presented toward the grading window 106 is small enough to enter the window while other parts of the pod are too large to pass completely through, the pod may lodge in the window and be carried along in it as the drum 12 rotates. As the panels 40 are moved to the clearing position near the top of the drum 12, as previously described, the grading windows 106 open, and any pods lodged in them fall free and back into the mass of pods contained within the drum. As the mass of pods moves through the drum 12 from the feed end 16 to the discharge end 20, the pods are repeatedly presented to grading windows 106 with the result that the pods are separated by size into those small enough to pass through the grading windows and out of the drum and those retained within the drum. The pods retained within the drum 12 are eventually discharged through the central passage 37 of the discharge end partition 29.

If desired, a series of drums 12 with associated movable panels 40 and other structures may be rigidly fastened end to end within a single frame. The grading positions of the movable panels 40 of each successive drum 12 may be selected to allow increasingly larger pods to pass through the grading windows 106 of each successive drum 12. The pods passing through the grading windows 106 of each successive drum 12 may be gathered separately, and by this means a mass of pods placed within the series of drums may be separated into as many different sizes of pods as there are drums 12, in addition to the size exiting from the drums at the discharge end 20 of the last drum.

The fixed grading structures 24 and the panel grading structures 92 preferably are molded from a suitable plastic. They may be unitarily molded. Alternatively and preferably, the fixed grading structures 24 and panel grading structures 92 are both made up of arrays of substantially identical grading segments 108, best shown in FIG. 6. Each grading segment 108 has at least one vane 110 corresponding in structure to vanes 78 and 94. The grading segment 108 also has a half vane 112 corresponding in structure to the half vanes 83 and 84, the half vane 112 extending parallel to vane 110. The flat side 114 of the half vane 112 is presented outwardly at one side of the grading segment 108. The grading segment 108 has reinforcement members 116, end structures 117, arcuate attachment members 118, and locator fingers 120, corresponding in shape and position to the reinforcement members 90 and 94, end structures 85 and 102, arcuate attachment members 86 and 104, the locator fingers 101 and 103 of the fixed grading structures 24 and the panel grading structures 92. The distance between vane 110 and half vane 112 (and between vanes 110 if the segment 108 has more than one vane 110) is selected to be the distance desired between the vanes 78 of the fixed grading structure 24 and that between the panel grading vanes 94. The distance between the vane 110 and the coplanar surfaces 109 of the grading segment 108 most remote from the half vane 112 is selected to be one half of the distance between the half vane 112 and the vane 110.

When two grading segments 108 are placed side by side with the flat sides 114 of each grading segment to the outside of the structure composed of the two segments, a fixed grading structure 24 is formed, as is shown in exploded form in FIG. 6 and in cross section in FIG. 5. When two grading segments 108 are placed side by side with the flat sides 114 facing each other, the two half vanes 112 combine to form a vane 94, and a panel grading structure 92 is formed, as is shown in cross section in FIGS. 4 and 5. The grading segments 108 have a notch 115 adapted to form a partition notch 88 when the grading segment 108 is combined with a second segment 108 to form a fixed grading structure 24. When the grading segments 108 are assembled as panel grading structures, a spacer 118 is used to fill the space left by the abutting notches 115 of the grading segments so assembled, as is best seen in FIGS. 4 and 5.

Figure 8:
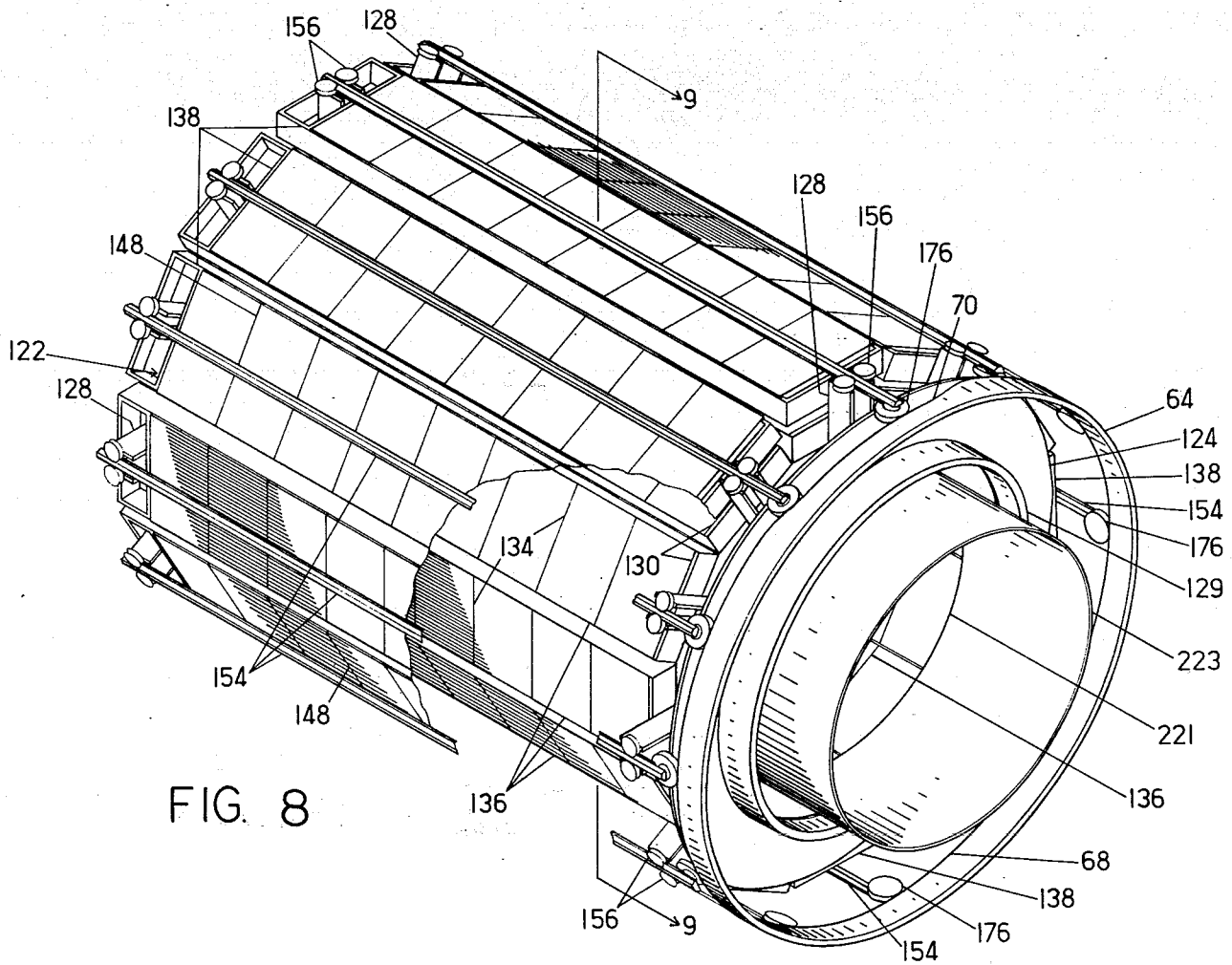
FIG. 8 is a perspective view of a second and preferred embodiment of the drum of the size grader of the invention shown from the discharge end, with portions of the movable panels broken away, with the fixed grading structures and the panel grading structures shown schematically, and with the cam ring shown schematically in proper relation to the drum.
Figure 14:
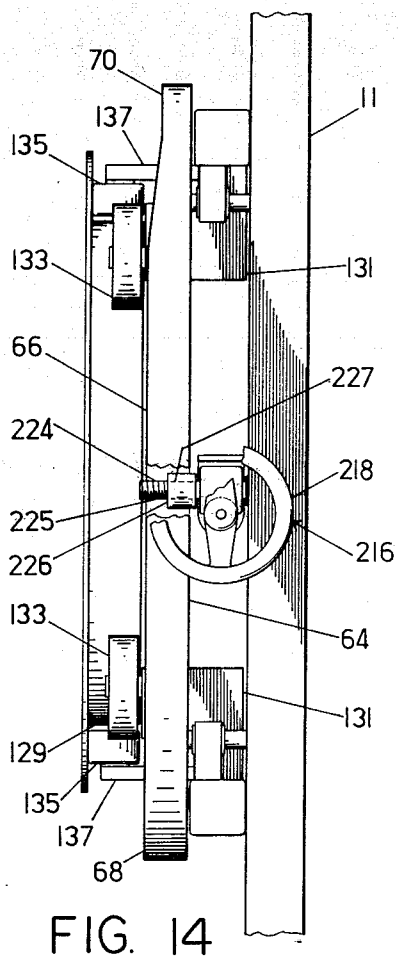
FIG. 14 is a side elevation view of the frame and associated structures shown in FIG. 13.
Figure 13:
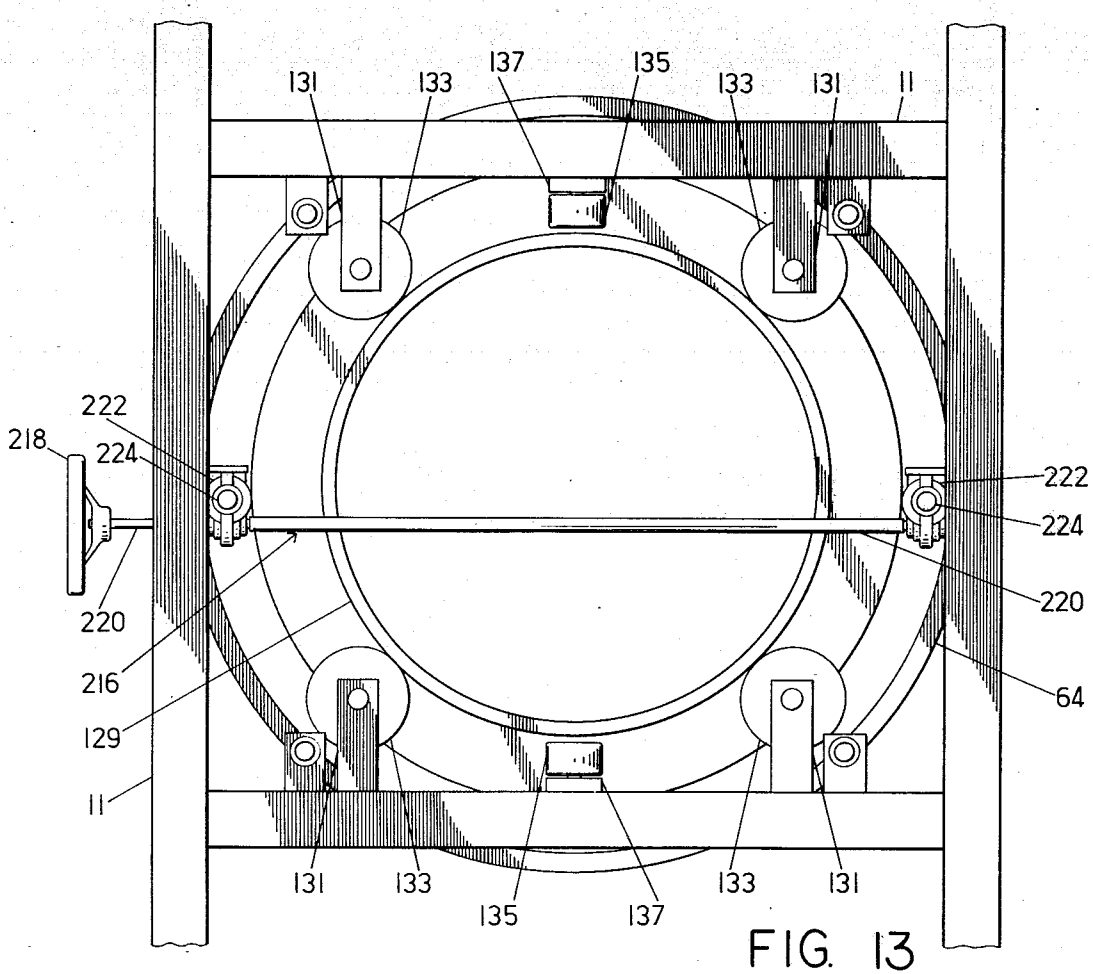
FIG. 13 is an end elevation view of the discharge end of the frame of the size grader of the invention, together with the preferred means for adjusting the position of the cam ring, means for supporting the drum shown in FIG. 8, and associated parts of the drum shown in FIG. 8.

A second preferred embodiment of the bean grader of the invention employs a drum 122, as shown in FIG. 8. The drum 122 has a discharge endplate 124 and a feed endplate 126, best shown in FIGS. 10 and 11. Support rings 129 are rigidly attached to and extend coaxially with the drum 122 outwardly from the endplates 124 and 126 for selected distances. A selected number of support roller brackets 131 (shown in FIGS. 13 and 14) are rigidly attached to the frame 11. Freely turning support rollers 133 are mounted on the brackets 131 and are adapted to engage the support rings 129 in rolling relation. At least two and preferably four support rollers 133 engage each support ring 129. A selected number of stabilizing rollers 135 mounted on brackets 137 rigidly attached to the frame 11 are adapted to engage the endplates 124 and 126 so as to prevent movement of the drum in a direction parallel to its axis. Thus the drum is supported by the frame 11 and is adapted freely to rotate about its axis when driven by any conventional means (not shown) of rotating the drum of a drum-type pod vegetable handling machine.

The drum 122 has a plurality of fixed banks 136 enclosing fixed grading structures 134 functionally analogous to the banks 38 previously described. The banks 136 are supported and constructed as follows. A selected number of pairs of primary support members 128 are rigidly attached to the periphery of discharge endplate 124, and opposed pairs of primary support members 128 are rigidly attached to the periphery of the feed endplate 126. Each set of corresponding, opposed pairs of primary support members 128 extends outwardly from the drum 122 for a selected distance, parallel to a radius of the drum. Each pair of primary support members 128 extends longitudinally with respect to th drum 122 toward the opposed pair of primary support members for a selected distance.

A bank end piece 130 is associated with each pair of primary support members 128. The bank end piece 130 is of a selected length, extending laterally relative to the drum 122, and is rigidly fastened to the associated pair of primary support members 128.

Bank side pieces 132 extend between the bank end pieces 130 associated with each opposed pair of primary support members 128. At least one and preferably a multiplicity of fixed grading structures 134 extend laterally relative to the drum 122, spanning the distance between the bank side pieces 132. The fixed grading structures 134 are rigidly fastened to the bank side pieces 132. Taken together, each set of associated bank end pieces 130, bank side pieces 132, and fixed grading structured 134 form a flat, fixed bank 136. The drum 122 preferably has twelve such banks 136, which collectively form the periphery of the drum 122. The bank side pieces 132 of a given fixed bank 136 are set close enough to the bank side pieces 132 of the adjacent fixed banks 136 to substantially prevent the contents of the drum 122 from passing therebetween.

Figure 9:
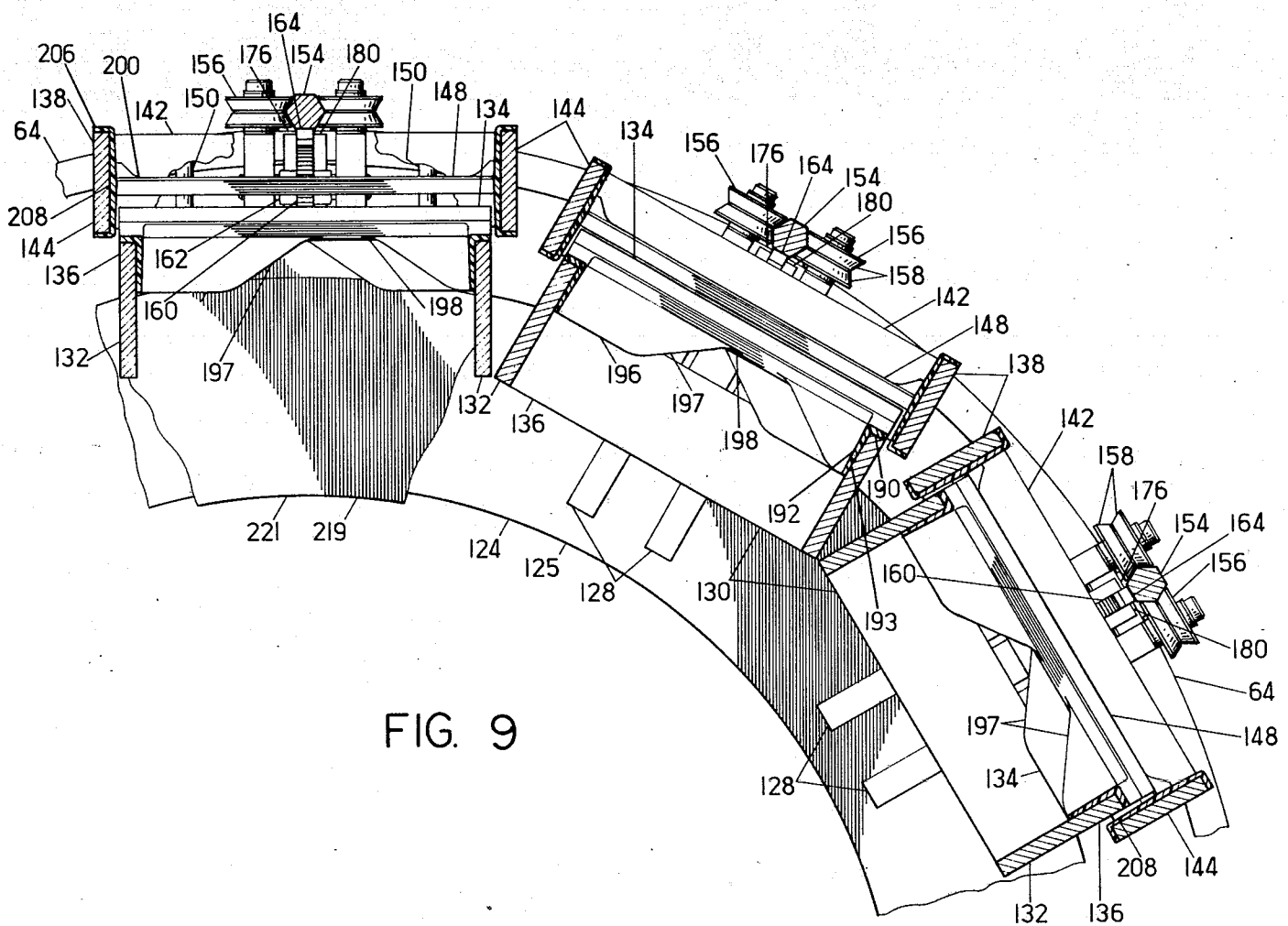
FIG. 9 is a cross sectional view of a broken away portion of the drum shown in FIG. 8, taken along section lines 9—9, with various parts of the drum further broken away to reveal underlying parts.

A movable panel 138, generally corresponding to the movable panel 40 described above, is located radially outward from and substantially in a plane that is parallel to the plane of each bank 136, as shown in FIG. 9. Each movable panel 138 is mounted on the drum 122 in a manner described below and is selectively movable relative to the corresponding fixed bank 136 in a direction parallel to that radius of the drum 122 that bisects the bank 136. All of the movable panels 138 are the same in structure, and subsequent references to one such panel equally apply to all of them.

Figure 10:
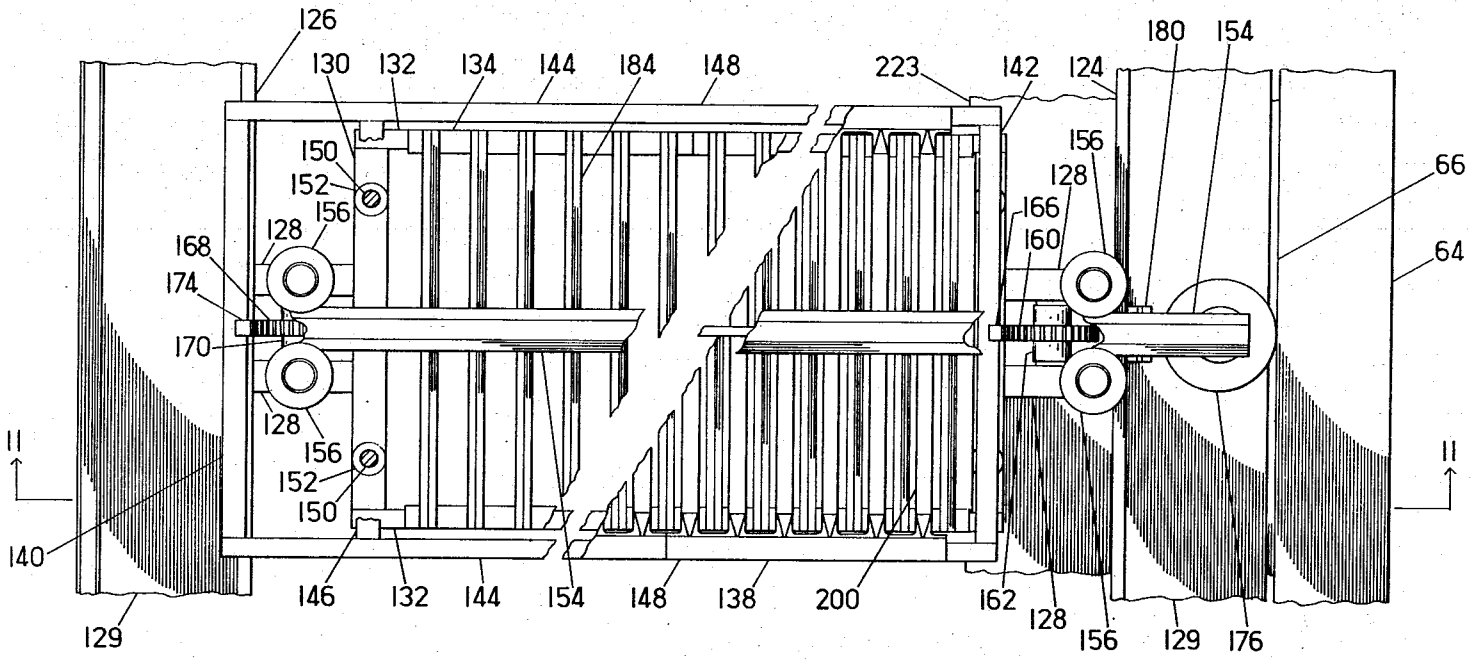
FIG. 10 is a plan view of a movable panel of the drum shown in FIG. 8, together with broken away portions of associated structures.

Preferably, as shown in FIG. 10, the movable panel 138 is substantially rectangular and has a feed endcap 140 and an opposed discharge endcap 142. A movable panel side piece 144 extends from each end of the feed endcap 140 to the corresponding end of the discharge endcap 142, to form a rectangle. An intermediate partition 146 extends between the movable panel side pieces 144 at a selected distance from the feed endcap 140 and preferably is oriented parallel to the feed endcap. At least one and preferably a multiplicity of panel grading structures 148 span the distance between the movable panel side pieces 144 and fill the space between the intermediate partition 146 and the discharge end cap 142. The feed endcap 140, discharge endcap 142, movable panel side pieces 144, intermediate partition 146, and panel grading structures 148 are all rigidly fastened together and, taken together, form the movable panel 138.

At least one and preferably two guide pins 150 are rigidly fastened to each of the discharge endcap 142 and the intermediate partition 146. The guide pins 150 are oriented parallel to the radius of the drum 122 that bisects the bank 136 and are adapted to extend through and slideably engage bushings 152 mounted in the bank end pieces 130. Consequently, when in place over the bank 136, the movable panel 138 is held in a plane substantially parallel to that of that bank at the same time that sideways movement relative to the bank is prevented.

The drum 122 of the second embodiment has a means for selectively controlling the distance between the movable panel 138 and the fixed bank 136. A control rod 154 having an equilaterally hexagonal cross section extends across the movable panel 138 in a direction substantially parallel to the longitudinal axis of the drum 122, as shown in FIGS. 8–11. Preferably, the hexagonal control rod 154 is centered over the movable panel 138 and is so oriented that one of its sides is parallel to the plane of the panel 138. Two guide rollers 156 are attached to each pair of primary support members 128 in freely rotating relation. Each guide roller 156 is substantially cylindrical with bearing surfaces 158 defining a notch extending circumferentially about the guide roller, the bearing surfaces 158 intersecting at an angle of substantially 120°. The guide rollers 156 rotate about axes that are parallel to the radius of the drum 122 that bisects the panel 138, and the notches defined by surfaces 158 of both rollers 156 are oriented in the same place. The guide rollers 156 are so spaced relative to each other that they may receive between them against their bearing surfaces 158 the hexagonal control rod 154 in freely rolling relation. Thus, by means of the guide rollers 156 located at each end of the fixed bank 136, the hexagonal control rod 154 associated therewith is limited to axial motion.

In the preferred embodiment, there are two primary support members 128 at each end of the fixed bank 136, with one primary support member on either side of the hexagonal control rod 154. One guide roller 156 is mounted on the top of each primary support member 128, with the hexagonal control rod 154 received between them, as described above.

A pinion 160 is mounted on an axle 162 that is oriented at a right angle to the hexagonal control rod 154 and at a right angle to the radius of the drum 122 that bisects the control rod. The axle 162 is received in freely turning relation by bushings (not shown) mounted in the primary support members 128, so that the pinion 160 is held between the primary support members. A driving rack 164 is engaged by the pinion 160 and is rigidly fastened to and extends parallel to the hexagonal control rod 154. A driven rack 166, also engaged by the pinion 160, is oriented parallel to the radius of the drum 122 that bisects the panel 138 and at right angles to the driving rack 164. The driven rack 166 is rigidly attached to a selected surface of the discharge endcap 142 of the movable panel 138 that faces toward the discharge end plate 124. It will be appreciated that, as the hexagonal control rod 154 is moved toward the feed endplate 126, the driving rack 164 turns the pinion 160, which in turn drives the driven rack 166, causing the movable panel 138 to move toward the fixed bank 136. An opposite movement of the hexagonal control rod 154 reverses this action, moving the movable panel 138 away from the fixed bank 136.

In the preferred embodiment, as shown in FIG. 10, the primary support members 128 that are fastened to the feed endplate 126 extend outwardly from the drum 122, passing between the feed endcap 140 and the intermediate partition 146 of the movable panel 138. These primary support members 128 are equally spaced on either side of the hexagonal control rod 154, and one guide roller 156 is mounted on each such support member, with the hexagonal control rod received therebetween. A pinion 169 (comparable to the pinion 160) mounted on an axle 170 (comparable to the axle 162) freely turns in bushings (not shown) mounted in the primary support members 128. A driving rack 172 extending parallel to the hexagonal control rod 154 is rigidly attached thereto and is engaged in the pinion 168. A driven rack 174 is attached to a selected surface of the feed endplate 126 that faces the intermediate partition 146. The driving rack 172 and driven rack 174 are generally comparable to the driving rack 164 and driven rack 166, and the relative interaction described above of the control rod 154, driving rack 164, pinion 160, and driven rack 166 are paralleled by the corresponding pinion 168, driving rack 172, and driven rack 174 just described. By means of the corresponding rack and pinion structures described, the movements of the movable panel 138 may be more positively controlled than would be possible with only one such rack and pinion structure, and the simultaneous movement of both ends of the panel may be ensured, thus preventing binding of the guide pins 150 and inaccurate alignment of the movable panel 138 with the fixed panel 136.

The hexagonal control rod 154 extends for a selected distance beyond the discharge endplate 124. A cam follower wheel 176 is attached to the control rod 154 in freely rotating relation at a selected point beyond the discharge endplate 124. The axis of the cam follower wheel 176 is oriented substantially on a radius of the drum 122. The cam follower wheel 176 is generally analogous to the cam follower wheel 62 described above and is adapted to follow the cam ring surface 66 of the cam ring 64, described above.

Figure 11:
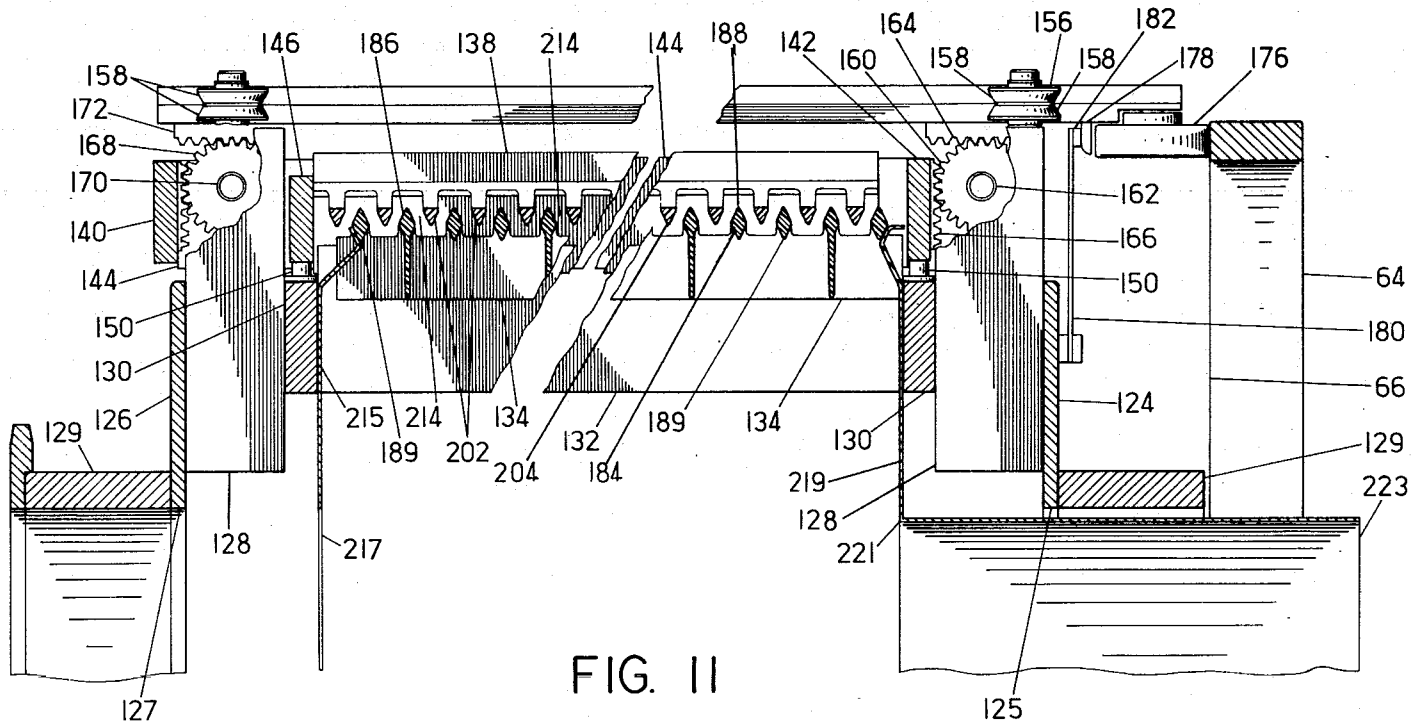
FIG. 11 is a cross sectional view of the movable panel shown in FIG. 10, taken along section lines 11—11.

Referring to FIG. 11, a block 178 is rigidly attached to the hexagonal control rod 154 at a desired location, preferably between the point that the cam follower wheel 176 is attached to the control rod and the point at which the control rod contacts the first set of guide rollers 156. One end of a leaf spring 180 is rigidly attached to the discharge endplate 124 and extends outwardly to the block 178. The leaf spring 80 is adapted to be in contact with the block 78 and exert a selected force thereagainst. Preferably a wear pad 182 is attached to the leaf spring 180 and is interposed between the leaf spring 180 and the block 178. By means of the force exerted by the leaf spring 180, the hexagonal control rod 154 is biased towards the cam ring 64, whereby the cam follower wheel 176 is biased against the cam ring surface 66 and moves away from and toward the drum 122 as the cam follower wheel passes from the grading level 68 to the clearing level 70 and back again as the drum 122 rotates. The motion of the cam follower wheel 176 is transmitted to the movable panel 138 by the interaction of the control rod 154 and the driving racks 164 and 172, the pinions 160 and 168, and the driven racks 166 and 174, as described above, so that the movable panel is moved towards the fixed bank 136 as the cam follower wheel passes to the grading level, assuming a selected grading position, and moves away therefrom as the cam follower wheel moves to the clearing level.

Referring now primarily to FIGS. 9–12, the fixed grading structure 134 has equally spaced, parallel, fixed grading vanes 184 extending between the bank side pieces 132 of the fixed bank 136. Fixed grading surfaces 186 extend from a section of greatest width of the vane 184 away from the drum 122 to a point of lesser width at that part of the vane 184 most remote from the axis of the drum, which part hereinafter shall be referred to as the leading edge 188 of the fixed grading vane 184. Preferably the cross section of that part of the vane 184 extending from the section of greatest width to the leading edge 188 forms an isosceles triangle having its base at the section of greatest width. Surfaces extend from the section of greatest width inwardly toward the axis of the drum 122, preferably presenting a smooth back surface 189 toward the interior of the drum so as to minimize the abrasion of pod vegetables tumbling within the drum.

End structures 190 of the fixed grading structure 134 extend substantially parallel to the bank side pieces 132 and are rigidly attached to the ends of the fixed grading vanes 184, joining a selected number of such vanes into a single fixed grading strucuture 134. An end stiffener 192 extends inwardly relative to the drum 122 from the end structure 190 for a selected distance. Surfaces 193 of the end structures 190 and end stiffeners 192 are adapted to conform to the shape of the bank side pieces 132 and to fit tightly thereagainst, as best shown in FIG. 9. Preferably the end structures 190 have surfaces defining holes 194 through which bolts extend (not shown) to threadedly engage the bank side pieces 132 and rigidly attach the fixed grading structure 134 thereto.

A selected number of anti-roping vanes 196 extend inwardly relative to the drum 122 from the back surfaces 189 of selected fixed grading vanes 184 for a selected distance. The anti-roping vanes 196 preferably are narrow relative to the fixed grading vanes 184. Preferably each anti-roping vane 196 has surfaces 197 inclining from the point of greatest inward extension of the anti-roping vane outwardly to the back surface 189 to define an inwardly opening gap 198 in the anti-roping vane. The gaps 198 are so located that they are in circumferentially displaced relation in respect to each adjacent gap 198. The vanes 196 with surfaces 197 defining adjacent gaps 198, as well as the inwardly extending bank side pieces 132, provide an agitating passageway through the drum 122. Rotation of the drum 122 draws successively displaced surfaces 197 transversely through the mass of pod vegetables within the drum to agitate and break up the mass and thus prevent "roping" of the mass through the drum.

The panel grading structure 148 has panel grading vanes 200 extending parallel to the fixed grading vanes 184. Panel grading surfaces 202 extend from a section of greatest width of the panel grading vane 200 toward the drum 122 to a point of lesser width at that part of the panel grading vane nearest to the axis of the drum, hereinafter referred to as the leading edge 204 of the panel grading vane 200. Preferably, the shape of the panel grading vanes 200 is substantially the same as the shape of the fixed grading vanes 184.

Figure 12:
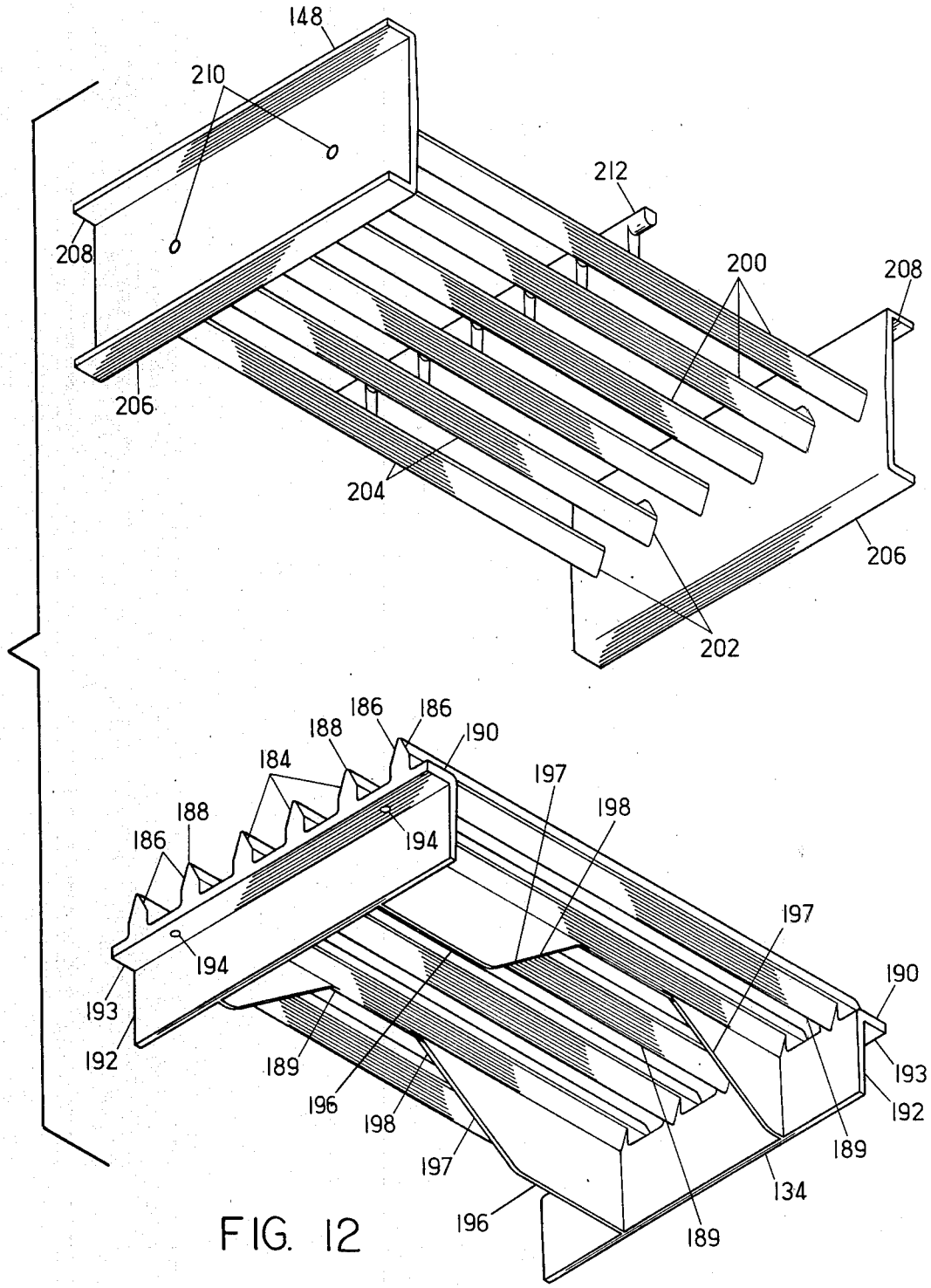
FIG. 12 is an exploded perspective view of a fixed grading element and a panel grading segment of the drum shown in FIG. 8, showing their relative positions when assembled to form a part of the drum.

As best shown in FIGS. 9 and 12, end structures 206 extend across the ends of the panel grading vanes 200 and are rigidly attached thereto, holding them in equally spaced relation. Surfaces of the end structures 206 define attachment grooves 208 adapted to embracingly engage the movable panel side pieces 144. The movable panel grading structures 148 are rigidly attached to the movable panel side pieces 144 by any suitable conventional means of attachment, such as screws (not shown) extending through the panel side pieces to be threadedly engaged in attachment holes 210. Preferably a reinforcement member 212 extends substantially at right angles to the panel grading vanes 200 and is rigidly attached to selected surfaces thereof remote from the leading edges 204 of the vanes. The reinforcement member 212 is adapted to strengthen the panel grading structure 148 and to maintain constant the distance between adjacent panel grading vanes 200, all without obstructing the spaces between the vanes.

The fixed grading structures 134 and panel-grading structures 148 may be made of any desired length and contain a selected number of vanes 184 and 200. In the preferred embodiment, fixed grading structures and panel grading structures 134 and 148 are made with six vanes 184 and 200, respectively, and a multiplicity of such fixed and panel grading structures are fastened successively to the bank side pieces 132 and panel side pieces 144, respectively, to create fixed banks 136 and movable panels 138 of desired lengths.

The panel grading structures 148 are so located relative to the fixed grading structures 134 that the leading edges 188 of the fixed grading structures substantially face the leading edges 204 of the panel grading structures, with the leading edges 188 parallel to and centered between the opposed leading edges 204. As each movable panel 138 is increasingly depressed toward the opposed fixed bank 136, the panel grading vanes 200 enter the spaces between the fixed grading vanes 184, as is best shown in FIG. 11. Each panel grading surface 202 and the adjacent fixed grading surface 186 define a grading window 214, in a manner analogous to the interrelationships of panel grading surface 96 and fixed grading surfaces 80, described above. As a movable panel 138 is increasingly depressed, adjacent grading surfaces 186 and 202 more nearly approach each other, reducing the size of the grading windows 214. When the panel 138 is moved to the clearing position, as discussed above, the grading surfaces 186 and 202 are pulled back from each other and the grading windows 214 are made larger, allowing any pods lodged therein to fall free.

A feed end liner 215, shown in FIG. 11, is rigidly attached to selected surfaces of the bank end pieces 130 located at the feed end of the drum 122. The feed end liner extends from the back surfaces 189 of the fixed grading vanes 184 located closest to the feed endplate 126 inwardly toward the axis of the drum 122. Surfaces of the feed end liner 215 define a central passageway 217 through which pod vegetables may be introduced to the interior of the drum 122.

A discharge end liner 219 is rigidly attached to the bank end pieces 130 located closest to the discharge endplate 124. The discharge end liner 219 extends from the back surface 189 of the fixed grading vanes 184 located closest to the discharge endplate 124 inwardly toward the axis of the drum 122 for a selected distance. Surfaces of the discharge end liner 219 define a central passageway 221 extending therethrough. A discharge tube 223 is rigidly attached to the surfaces defining the central passageway 221 and extends coaxially with the drum 122 through the discharge passageway 125 for a selected distance. The discharge tube 223 is comparable in function to discharge tube 39, described above, and serves to carry pod vegetables being discharged from the drum 122 to a convenient point where they may be discharged into a suitable receptacle. Together, the feed end liner 215, discharge end liner 219, and discharge tube 223 prevent pod vegetables that have been introduced to the drum 122 from contacting any parts of the drum 122 except the fixed and panel grading structures 134 and 148.

The cam ring 64 is adapted to be selectively movable toward or away from the drum 122 in a direction parallel to the longitudinal axis of the drum, so that the size of the grading windows may be adjusted. The preferred means for adjusting the position of the cam ring 64 is shown at 216 in FIGS. 13 and 14. The preferred adjusting means 216 includes a cranking handle 218 rigidly mounted on a driving shaft 220. Preferably the driving shaft 220 is substantially horizontal and is oriented at right angles to the longitudinal axis of the drum 122, extending from one side of the cam ring 64 substantially to the other side thereof.

The driving shaft 200 is supported by and is adapted to drive two conventional right angle gear drives 222, each of which is rigidly attached to a convenient part of the frame 11 and is adapted to mechanically convert the rotation of the driving shaft 220 about its longitudinal axis into rotational movement imparted to shafts 224 oriented substantially parallel to the longitudinal axis of the drum 122. Any appropriate conventional right angle gear drive may be used as the gear drive 222. Preferably, a gear drive is selected in which the shaft 220 drives the shaft 224 with a selected mechanical advantage. In the preferred embodiment, a gear drive having a $2\frac{1}{2}$ to 1 ratio is used, the preferred gear drive being obtainable under the trademark "FLOAT-A-SHAFT" from Tolo-matic, 1028 South Third Street, Minneapolis, Minnesota 55415. Surfaces of the shafts 224 define external threads 225. Two nuts 226 are rigidly attached to the cam ring 64, the nuts 226 each having internal surfaces defining threaded holes 227 (shown in phantom in FIG. 14) adapted to receive the external threads 225 of the shaft 224 in freely turning, threaded relation.

When it is desired to move the cam ring 64, the operator turns the cranking handle 218 in a desired direction, thereby rotating the driving shaft 220. The motion of the shaft 220 is transmitted through both right angled gear drives 222 at a selected mechanical advantage to the two threaded shafts 224. The nuts 226 in which the threaded shafts 224 are threadedly engaged are thereby driven along the threads 225 of the threaded shafts 224, moving either toward or away from the drum 122, depending upon the direction in which the cranking handle 218 has been turned. The cam ring 64 moves with the nuts 226. It will be appreciated that, because the size of the grading windows 214 is dependent upon the degree to which the movable panel 138 is depressed toward the fixed bank 136, as explained above, and since the movement of the panel 138 is controlled by the movement of the hexagonal control rod 154, the position of which is governed by the movements of the cam follower wheel 176 on the cam ring surface 66, the operator can control the size of the grading windows at will by manipulation of the cranking handle 218. It will be apparent that the cam ring 64 may be adjusted both when the drum 122 is rotating and when it is stationary, so that the size of the grading windows 214 may be adjusted while the bean grader is in operation.

All rigid parts described above may be made from metal, strong plastics, or any other suitable conventional rigid material by means of conventional metal or plastic working techniques. The grading structures 134 and 148 preferably are made from a suitable plastic by molding. However it is understood that the invention is not confined to the particular construction, materials, and arrangement of parts herein illustrated and described, and that various changes may be made without departing from the spirit of the invention. The invention embraces all such modified forms thereof as come within the scope of the following claims.

What is claimed is:

1. A size grader (10) for grading pod vegetables placed therein, comprising:

(a) a substantially cylindrical drum (12, 122), supported in rotatable relation along its longitudinal axis on a frame (11);

(b) banks (38, 136) mounted circumferentially on the drum (12, 122) and having fixed grading vanes (78, 184) extending substantially laterally to the longitudinal axis of the drum (12, 122);

(c) a movable panel (40, 138) oriented outwardly from each bank (38, 136) and mounted on the drum (12, 122), adapted to move independently toward and away from the bank (38, 136), and having panel grading vanes (94, 200) adapted to register with the fixed grading vanes (78, 184) as the panel (40, 138) moves toward the bank (38, 136), the adjacent fixed grading vanes (78, 184) and panel grading vanes (94, 200) defining grading windows (106, 214) therebetween, the grading windows (106, 214) decreasing in size as the panel (40, 138) moves increasingly toward the (38, 136); and (d) means for selecting and independently changing the position of each panel (40, 138) relative to its associated bank (38, 136) as the drum (12, 122) rotates, to cause the panel grading vanes (94, 200) to move toward the fixed grading vanes (78, 184) of the bank into a selected grading position to define grading windows (106, 214) of a selected size as the panel (40, 138) passes beneath the drum (12, 122) and to move away from the fixed grading vanes (78, 184) and into a clearing position as the panel (40, 138) passes above the drum (12, 122).

2. The size grader (10) specified in claim 1 in which the means for selecting and changing the position of the panels (138) relative to the banks (136) includes at least one rack and pinion mechanism adapted to drive each panel (138) toward and away from each associated bank (136).

3. The size grader (10) specified in claim 2 in which the rack and pinion mechanism includes:

(a) a control rod (154) attached to the drum (122) in movable relation;

(b) at least one driving rack (164, 172) extending for a selected distance along the control rod (154);

(c) at least one rotatable pinion (160, 168) engaged in the driving rack (164, 172);

(d) at least one driven rack (166, 174) engaged in the pinion (160, 168), rigidly attached to the panel (138) and oriented parallel to the radius of the drum (122) that bisects the bank (136);

(e) means for selectively moving the control rod (154).

4. The size grader (10) specified in claim 1 in which the means for selecting and changing the position of the panels (138) relative to the banks (136) includes:

(a) a control rod (154) associated with each panel (138), extending in a direction substantially parallel to the longitudinal axis of the drum (122) and attached to the drum (122) in longitudinally movable relation;

(b) at least one driving rack (164, 172) extending for a selected distance along the control rod (154);

(c) at least one rotatable pinion (160, 168) engaged in the driving rack (164, 172);

(d) at least one driven rack (166, 174) engaged in the pinion (160, 168), rigidly attached to the panel (138) and oriented parallel to the radius of the drum (122) that bisects the bank (136);

(e) a cam follower wheel (176) rotatably attached to the control rod (154) and oriented with its axis substantially parallel to a radius of the drum (122); and (f) a cam ring (64) supported by the frame (11) and having a cam ring surface (66) adapted to engage the cam follower wheel (176) to determine the longitudinal position of the control rod (154), the cam ring surface (66) having a grading level (68) selected to be such that when the cam follower wheel (176) is engaged therewith the movable panel (138) will be moved to a selected grading position, and a clearing level (70) selected to be such that when the cam follower wheel (176) is engaged therewith the movable panel (138) will move to a selected clearing position.

5. The size grader (10) specified in claim 3 or 4 including means for attaching the control rod (154) to the drum (122) wherein at least two substantially cylindrical guide rollers (156) are attached to the drum (122), each guide roller (156) having bearing surfaces (158) extending circumferentially about the guide roller (156), the guide rollers (156) being spaced relative to each other such that their bearing surfaces (158) engage the control rod (154) therebetween in rollable relation.

6. The size grader (10) specified in claim 5 wherein the control rod (154) has flat surfaces engaged with the bearing surfaces (158), whereby the control rod (154) is prevented from turning about its longitudinal axis.

7. The size grader (10) specified in claim 1 in which the means for selecting and changing the position of the panel (40) relative to the bank (38) includes:

(a) a control rod (52) extending across the panel (40) in a direction substantially parallel to the longitudinal axis of the drum (12) and means for attaching the control rod (52) to the drum (12) in longitudinally movable relation;

(b) at least one cam block and cam follower mechanism driven by the control rod (52) and adapted to drive the panel (40) toward and away from the bank (38); and (c) means for selectively moving the control rod (52).

8. The size grader (10) specified in claim 3 or 7 in which the means for selectively moving the control rod (52, 154) includes:

(a) a cam follower wheel (62, 176) attached to the control rod (52, 154) and oriented with its axis substantially parallel to a radius of the drum (12, 122);

(b) a cam ring (64) supported by the frame (11) and having a cam ring surface (66) adapted to engage the cam follower wheel (62, 176) to determine the longitudinal position of the control rod (52, 154), the cam ring surface (66) having a grading level (68) selected to be positioned such that when the cam follower wheel (62, 176) is engaged therewith the movable panel (40, 138) will be moved to a selected grading position, and a clearing level (70) selected to be positioned such that when the cam follower wheel (62, 176) is engaged therewith the movable panel (40, 138) will be moved to a selected clearing position; and (c) means for biasing the cam follower wheel (62, 176) against the cam ring surface (66).

9. The size grader (10) specified in claim 8 including a means for adjusting the position of the cam ring (64) whereby the cam ring (64) may be selectively moved toward and away from the drum (12, 122) in a direction parallel to the longitudinal axis of the drum (12, 122) to adjust the size of the grading windows (106, 214).

10. The size grader (10) specified in claim 9 in which the means for adjusting the position of the cam ring (64)

includes at least one rack rack and pinion 76, the rack being attached to the cam ring (64) and extending in a direction parallel to the longitudinal axis of the drum (12, 122); and the pinion being adapted to drive the rack and mounted in rotatable relation on the frame (11).

11. The size grader (10) specified in claim 9 wherein the means for adjusting the position of the cam ring (64) includes:

(a) at least one member (226) rigidly attached to the cam ring (64) and having internal surfaces defining a threaded hole (227); and (b) at least one threaded shaft (224) having a longitudinal axis oriented parallel to the longitudinal axis of the drum (12, 122) and having external threads (225) adapted to threadedly engaged the threaded hole (227) of the member (226), the threaded shaft (224) being adapted to be turned about its longitudinal axis, whereby the cam ring (64) may be moved toward and away from the drum (12, 122) by turning the threaded shaft (224) about its longitudinal axis, whereupon the member (226) is driven along the threads (225) of the threaded shaft (224), the cam ring (64) moving with the member (226).

12. The size grader (10) specified in claim 11 wherein the means (216) for adjusting the position of the cam ring (64) includes:

(a) a cranking handle (218) rigidly mounted on a driving shaft (220), the driving shaft (220) being adapted to turn about its longitudinal axis; and (b) at least one right angle gear drive (222), adapted to be driven by the driving shaft (220) and to drive the threaded shaft (224).

13. The size grader (10) specified in claim 1 in which:

(a) each fixed grading vane (78, 184) has a pair of fixed grading surfaces (80, 186) extending from a section of greatest width of the vane (78, 184) outwardly to a common leading edge (82, 188);

(b) each panel grading vane (94, 200) has a pair of panel grading surfaces (96, 202) extending inwardly from a section of greatest width of the vane (94, 200) to a common leading edge (98, 204);

(c) and wherein the panel leading edges (98, 204) of the panel grading vanes (94, 200) substantially face the fixed leading edges (82, 188) of the fixed grading vanes (78, 184), with the panel leading edges (98, 204) parallel to and centered between the fixed leading edges (82, 188), whereby as the panel grading vanes (94, 200) are increasingly moved toward the fixed grading vanes (78, 184) the panel grading surfaces (96, 202) more closely approach the fixed grading surfaces (80, 186), thereby reducing the size of the grading windows (106, 214).

14. The size grader (10) specified in claim 1 in which:

(a) the drum (122) has a discharge endplate (124) and a feed endplate (126);

(b) a selected number of pairs of primary support members (128) are rigidly attached to the periphery of the discharge endplate (124), and opposed pairs of primary support members (128) are rigidly attached to the periphery of the feed endplate (126);

(c) a bank end piece (130) is rigidly attached to each pair of primary support members (128), extending laterally relative to the drum (122); two bank side pieces (132) extend between the bank end pieces (130) fastened to opposing pairs of primary support members (128), the bank side pieces (132) being rigidly attached to the bank end pieces (130); and (d) at least one fixed grading structure (134) extends laterally relative to the drum (122) between the bank side pieces (132) and longitudinally relative to the drum (122) between the bank end pieces (130) to form a fixed bank (136).

15. The size grader (10) specified in claim 14 wherein the fixed grading structure (134) has a plurality of fixed grading vanes (184) extending substantially parallel to the bank end pieces (130), each fixed grading vane (184) having surfaces extending from a section of greatest width thereof inwardly toward the axis of the drum (122) to define an inwardly facing back surface (189), and in which a selected number of anti-roping vanes (196) extend inwardly relative to the drum (122) from the back surfaces (189) of the vanes (184) for a selected distance, each anti-roping vane (196) having surfaces (197) inclining from the point of greatest inward extension of the anti-roping vane outwardly toward the back surface (189) to define an inwardly opening gap (198), the gap (198) being so located that it is in circumferentially displaced relation with respect to each adjacent gap (198).

16. The size grader (10) specified in claim 1 in which:

(a) the drum (12) includes a multiplicity of partitions (26) extending transversely to the longitudinal axis of the drum (12) and having edges defining a multiplicity of sets of corresponding fastening holes (28) and edges defining central passages (34) therethrough; and drum tiebars (30) rigidly attached to the drum (12) and extending the length of the drum (12), one drum tiebar (30) passing through each set of corresponding fastening holes (28);

(b) the fixed grading vanes (78) are joined into fixed grading structures (24), which extend laterally relative to the drum (12) between adjacent drum tiebars (30) and longitudinally relative to the drum (12) between adjacent partitions (26), and which have end structures (85) having surfaces defining outwardly facing arcuate attachment members (86), each attachment member (86) embracingly engaging a tiebar (30) in rigidly attaching relation, the fixed grading structures (24) having an elastic flexibility selected to allow the fixed grading structures (24) to snap elastically into place over a pair of adjacent drum tiebars (30) when pressed firmly against them from outside the drum (12);

(c) the fixed grading vanes (78) are equally spaced and have a section of greatest width and a point of lesser width remote from the axis of the drum (12); and the fixed grading surfaces (80) present outwardly relative to the drum (12) and extend outwardly from the section of greatest width to the point of lesser width;

(d) the movable panel (40) includes two panel tiebars (100) rigidly attached to the panel (40) and extending for substantially the length of the panel (40) substantially parallel to the longitudinal axis of the drum (12);

(e) the panel grading vanes (94) are joined into panel grading structures (92), which have surfaces defining outwardly facing arcuate attachment members (104), each attachment member (104) embracingly engaging a panel tiebar (100) in rigidly, attaching relation, the panel grading structures (92) having an elastic flexibility selected to allow the panel grading structures (92) to snap elastically into place over the panel tiebars (100) of a movable panel (40) when pressed firmly against them; and (f) the panel grading vanes (94) have a section of greatest width and a point of lesser width presented toward the drum (12) and the panel grading surfaces (96) extend from the section of greatest width to the point of lesser width of the panel grading vanes (94).

17. The size grader (10) specified in claim 16 in which the fixed grading vane (78) and the panel grading vanes (94) are substantially identical in shape and spacing, and the fixed grading structures (24) and the panel grading structures (92) are comprised of identical grading segments (108), each grading segment (108) having two sides, a vane (78, 94, 110), a half vane (83, 84, 112) extending parallel to the vane (78, 94, 110) and having a flat side (87, 114) presented outwardly at one side of the grading segment (108), the distance between vane (78, 94, 110) and half vane (83, 84, 112) being the distance between the grading vanes (78, 94) and the distance between the vane (78, 94, 110) and the coplanar surfaces (109) of the grading segment (108) defining the side of the grading segment (108) remote from half vane (83, 84, 112) being one half of the distance between the grading vanes (78, 94), two grading segments (108) being placed side by side, to form a mixed grading structure (24) when the flat sides (114) are presenting outwardly, and to form a panel grading structure (92) when the two grading segments (108) are placed side by side with the flat sides (114) facing each other.

18. The size grader (10) specified in claim 17 wherein the grading segments (108) have (a) surfaces defining notches (115) adapted to form a partition notch (88) when the grading segments (108) are combined to form fixed grading structures (24) to receive the periphery of a partition (26), (b) end structures (117, 85, 102), and (c) reinforcement members (116, 90, 94) extending parallel to the longitudinal axis of the drum (12) and interiorly relative to the drum (12) for a selected distance when the grading segments (108) are employed as parts of fixed grading structures (24), the reinforcement members (116, 90, 94) being rigidly attached to the vanes (110, 78, 94) and half vanes (112, 83, 84) and being separated from each other and from the end structures (117, 85, 102) by a distance selected to be smaller than the average length of the pod vegetables to be graded.

* * * * *

UNITED STATES PATENT AND TRADEMARK OFFICE

CERTIFICATE OF CORRECTION

PATENT NO. : 4,361,239

DATED : November 30, 1982

INVENTOR(S) : Krishna R. Kumandan

It is certified that error appears in the above-identified patent and that said Letters Patent are hereby corrected as shown below:

Column 4, line 54, change "pnael" to --panel--.

Column 10, line 8, change "the" to --and--.

Column 11, line 2, change "th" to --the--.

Column 12, line 63, change "169" to --168--.

Column 13, line 34, change "80" to --180--.

Column 16, line 4, change "200" to --220--.

Signed and Sealed this

*Twenty-fourth* Day of *May 1983*

[SEAL]

*Attest:*

DONALD J. QUIGG

*Attesting Officer* *Acting Commissioner of Patents and Trademarks*